United States Patent [19]

Podrini

[11] Patent Number: 4,640,757

[45] Date of Patent: Feb. 3, 1987

[54] VERTICAL CELLS FOR THE CONTINUOUS ELECTRODEPOSITION OF METALS AT HIGH CURRENT DENSITY

[75] Inventor: Maurizio Podrini, Rome, Italy

[73] Assignee: Centro Sperimentale Metallurgico S.p.A, Rome, Italy

[21] Appl. No.: 823,280

[22] Filed: Jan. 28, 1986

[30] Foreign Application Priority Data

Feb. 8, 1985 [IT] Italy ..... 47663 A/85

[51] Int. Cl.[4] ..... C25D 17/00

[52] U.S. Cl. ..... 204/206

[58] Field of Search ..... 204/206

[56] References Cited

U.S. PATENT DOCUMENTS

| | | | |
|---|---|---|---|
| 2,317,242 | 4/1943 | Allen | 204/206 |
| 2,535,966 | 12/1950 | Teplitz | 204/206 |
| 2,910,422 | 10/1959 | Egge | 204/206 |
| 3,880,744 | 4/1975 | Idstein | 204/206 |
| 4,434,040 | 2/1984 | Brendlinger | 204/206 |
| 4,518,474 | 5/1985 | Podrini | 204/206 |
| 4,526,668 | 7/1985 | Podrini | 204/206 |

*Primary Examiner*—T. M. Tufariello

*Attorney, Agent, or Firm*—Young & Thompson

[57] ABSTRACT

A plant comprising vertical cells for continuous electrodeposition of metals at high current density, in which the basic treatment unit consists of two vertical electrolytic cells connecting an upper chamber and a lower chamber for electrolyte collection and storage. The body to be plated, usually steel strip, passes from the upper chamber, through one of the cells, to the lower chamber when it returns, through the other of the cells, to the upper chamber. The electrolyte is forced to pass within these cells in a highly turbulent flow regime, by just one pumping unit.

3 Claims, 1 Drawing Figure

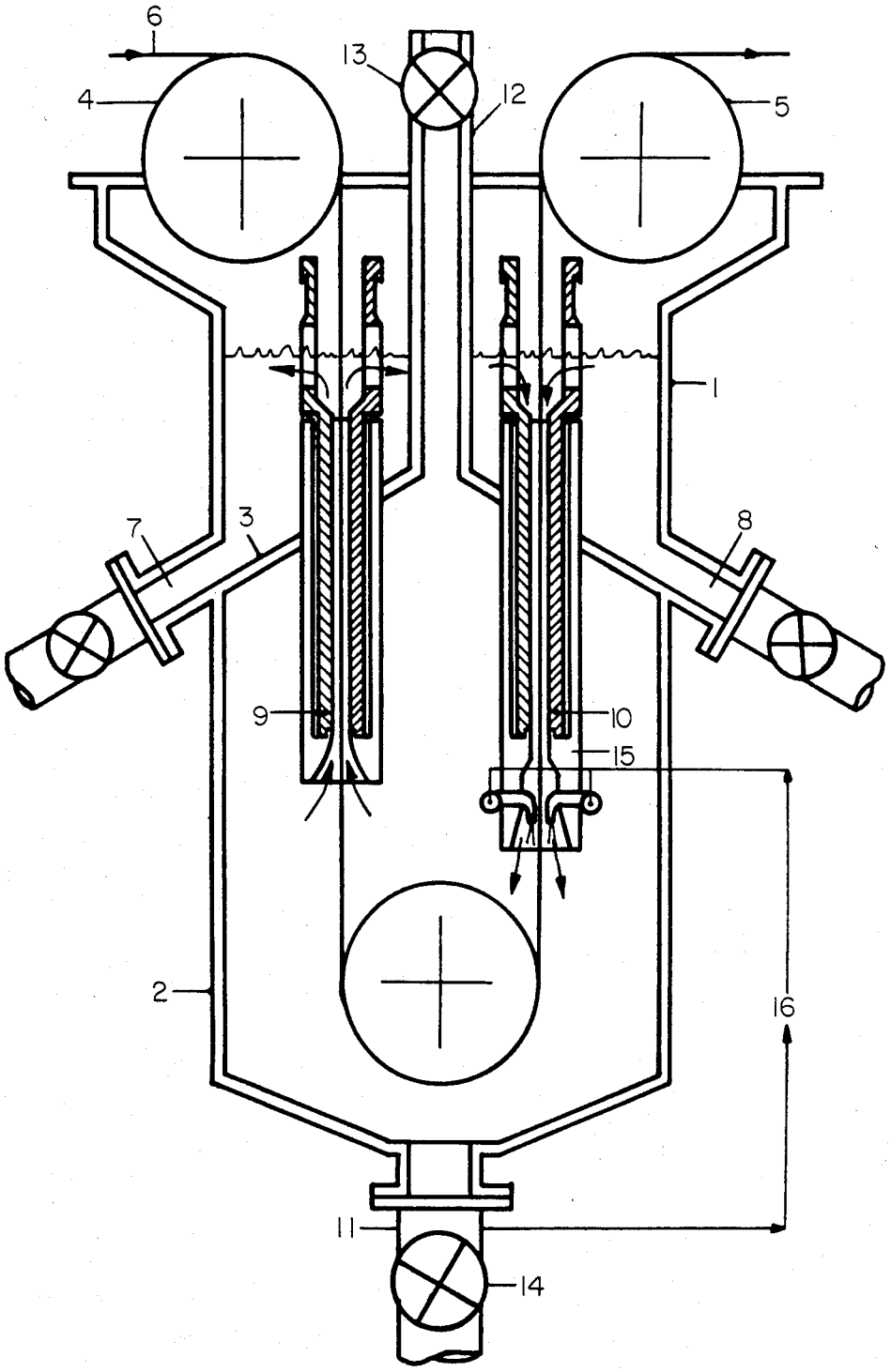
6
13
12
4
5
1
7
3
8
9
10
15
2
16
11
14

VERTICAL CELLS FOR THE CONTINUOUS ELECTRODEPOSITION OF METALS AT HIGH CURRENT DENSITY

SUMMARY

In a plant, consisting of vertical cells for continuous electrodeposition of metals at high current density, in which the basic treatment unit consists of two vertical electrolytic cells connecting an upper chamber and a lower chamber for electrolyte collection and storage, and in which the body to be plated, usually metal strip, passes from the upper chamber, through one of said cells, to the lower chamber from whence it returns, through the other of said cells, to the upper chamber, while the electrolyte is forced to pass within these cells in a highly turbulent flow regime, the improvement that is introduced consists in controlling the flow of said electrolyte by just one pumping unit.

DESCRIPTION

The present invention relates to a process for improvement of vertical cells for continuous electrodeposition of metals at high current density. More precisely it relates to the arrangement of the means for pumping the electrolyte and the conformation of the lower part of the plant. The improvements simplify the plant itself and the relevant maintenance operations, while also ensuring more uniform fluid dynamics treatment conditions.

In the continuous plating of metals, especially steel strip, with other protective metals (e.g. zinc and zinc alloyed with other metals such as iron, nickel, etc.), high strip speeds (even exceeding 150 m/min) and high current densities (even over 180 A/dm$^2$) are becoming more and more common. These high current density processes, of course, necessitate a certain relative velocity between the electrolyte and the strip to be plated—which acts as the cathode—so as to guarantee that the gas which is inevitably given off is removed from the vicinity of the strip, and also to ensure that the electrolyte flow is sufficiently turbulent to decrease the thickness of the boundary layer impoverished in metal ions that have to be deposited, thus permitting correct deposition and a satisfactory efficiency.

The processes concerned also require very constant fluid dynamics conditions—essential in electroplating—since it is these which have such an influence on the quality and composition of the coating and on the efficiency of the process.

From the theoretical point of view, high current density electroplating processes have decided advantages, some of which have actually been achieved to a certain extent in the plants built to date. However, the situation still does not seem to be completely stabilized, especially in the case of those semiproducts used to make certain quick-moving consumer durables which need excellent corrosion resistance combined with very pleasing appearance, such as strip used to build car bodies, for example.

For such products, especially steel strip coated with zinc and zinc alloyed with other metals (iron, nickel, etc.) it seemed initially that horizontal cell plants were probably the answer. Practical experience, however, does not appear to have been completely satisfactory, since works once using horizontal cells seem to be replacing them by vertical cells.

With the vertical arrangement, however, the strip passes from top to bottom in one set of cells and from bottom to top in another set, so it is impossible to ensure uniform fluid dynamics conditions at the strip-electrolyte interface in all the cells.

To eliminate this major difficulty, the Centro Sperimentale Metallurgico has already filed a patent application (No. 48617 A 84) for an invention which ensures that the direction of flow of the electrolyte in the cells is such as to achieve the necessaary uniformity of fluid dynamics conditions. In particular, in a pair of cells wherein the strip to be plated runs from top to bottom in one cell and from bottom to top in the other, means for pumping the electrolyte are installed in each cell at the points where the strip enters or leaves the cell, so that the flow of electrolyte in one cell of the pair is in the opposite direction to that in the other cell.

This plant arrangement has been tried in the works and has given excellent results. There are, however, a few secondary snags which cause some problems operationally. For instance, it is difficult to regulate the pumps in each pair of cells to ensure they are completely balanced. This results in lack of uniformity in electrolyte flow conditions which has an adverse effect on the uniformity of plating quality. Furthermore, the manner in which the pumps are installed makes it essential to adopt splash-guards which are, however, a possible source of damage for surface quality of the strip and the coating, while hindering cell maintenance.

The present invention is designed to eliminate these and other drawbacks by making available a plant that is simpler and cheaper than the previous ones while guaranteeing very rapid, highly turbulent flow of electrolyte in the treatment cells.

Another object of this invention is to ensure the same, identical fluid dynamics conditions in each cell of a pair, thus permitting the best possible plating yield and excellent plating quality.

In a plant for the continuous high current density electrodeposition of metals on other metal bodies in movement, especially steel strip, consisting of at least one treatment unit having an upper chamber and a lower chamber containing electrolyte and connected by two vertical electroplating cells, wherein the strip to be plated passes from said upper chamber downwards through the first of said cells to the lower chamber where it is diverted and returns upwards through the second of said cells to the upper chamber, while the electrolyte is forced to pass in the opposite direction in each of the two cells, an improvement is introduced to simplify the plant and ensure uniform fluid dynamics conditions in the cells.

The improvement according to the present invention is characterized by the fact that for each of said treatment units only one pumping device is utilized, this being located at one extremity of only one of the two vertical cells, the chamber to which the delivery of said pumping device is directed being completely filled with electrolyte and in direct, continuous communication with the outside only through the other chamber, via said vertical electroplating cells.

Said pumping device is preferably installed at the lower extremity of the cell which is traversed from bottom to top by said metallic body to be plated, with the delivery directed into the lower chamber; said pumping device can be advantageously formed of an ejector, that is a device in which the high kinetic energy of a quantity of primary fluid is used to entrain a larger quantity of secondary fluid, and whose primary entraining fluid consists of electrolyte taken from said lower chamber, while the entrained secondary fluid consists of electrolyte drawn from the upper chamber through the vertical cell on which the ejector is installed.

As said lower chamber is filled with electrolyte and closed, except for communication with the upper chamber via the vertical cells, the electrolyte pumped with the ejector from the upper chamber to the lower one through a cell can only rise to the upper chamber through the other cell.

As liquids are incompressible, it suffices to build the two cells with the same internal cross-sectional areas to ensure that the electrolyte flow rate and velocity in each cell is also exactly the same.

This invention is now described in greater detail by reference to an embodiment which is illustrated in the accompanying drawing showing a vertical section through a vertical cells treatment unit as per the invention; said description and illustration are given purely by way of exemplification and must in no way be construed as limiting.

The treatment unit, according to this embodiment, consists of a container divided into an upper chamber 1 and a lower chamber 2, spearated from each other by a partition 3. Chamber 1 is open at the top and has rolls 4 and 5 to guide the strip 6 as it enters and leaves the treatment unit, respectively. It also has valved outlets 7 and 8 needed to drain chamber 1 and to permit the re-establishment of pH and of the concentration of the various ions for electrodeposition by equipment not illustrated here, since the items involved in these subsidiary operations are already well known and do not require description. Lower chamber 2 is hermetically sealed from the outside and is in communication with chamber 1 only through electrolytic cells 9 and 10; it also has a pipe 11 at the bottom complete with valve 14 for draining the fluid from the chamber and means, generically indicated as 12 and 13, located in the upper part of chamber 2 for continuous evacuation of any gas that may accumulate in the chamber.

The partition 3, which divides chamber 1 from chamber 2, is so shaped as to form a higher area in chamber 2 for collection of such gas as may possibly accumulate there. Said partition 3 carries electrolytic cells 9 and 10. The lower part of the electrolytic cell through which the strip passes from bottom to top has devices to draw electrolyte from the upper chamber 1 into the lower chamber 2 through the cell itself 10. These devices consist preferably of an ejector unit 15 whose primary entraining fluid is the electrolyte itself, pumped by means of pump 16 from pipe 11 communicating with the lower chamber 2, while the secondary entrained fluid is the electrolyte itself contained within cell 10 continuously being drawn from upper chamber 1.

In operaton, pump 16 takes a certain flow of electrolyte from chamber 2 and returns it there via ejector 15, so that there is balanced circulation of that fluid in the chamber. However, the electrolyte pumped through the ejector as the primary fluid draws in other electrolyte from the upper chamber 1, through cell 10. In this way, there is a positive balance of electrolyte entering lower chamber 2.

Because of the structure of the lower chamber, however, the electrolyte drawn from the upper chamber cannot accumulate there, but can only rise from the lower chamber to the upper one via the electrolytic cell 9, at a flow rate that is certainly the same as that in cell 10, provided that the internal dimensions of the two cells are the same, which is easily achieved.

In this way the objectives of this invention are completely and satisfactorily attained, indeed, the plant is more economical and reliable because only one pumping unit is needed for every pair of cells; the use of ejectors necessarily ensures a high electrolyte velocity and flow in the cells under very turbulent conditions, the pressurization of the lower, indeformable chamber 2, constantly full of liquid, with electrolyte drawn in through one of the two cells, ensures that the same identical electrolyte flow rises towards the upper chamber through the other of the two cells, so as to guarantee identical fluid dynamics conditions in the two cells.

For simplicity and brevity this description omits all those particulars and details such as, for instance, the structure of the electrolytic cells and electrodes, current circuits, and external circuits for adjustment of electrolyte pH and concentration, which have no immediate bearing on this invention and which are well enough known not to require any special discussion.

It is important to observe, however, that the vertical cells as per the present invention provide further advantages in addition to those already indicated, especially concerning the great versatility of vertical cells of this type. In fact, as the upper part of the cells is completely free, insoluble or soluble anodes can be inserted, the width being readily varied, while masks for shielding the edge of the strip can be positioned and manoeuvred, thus permitting adoption of a wide range of deposition processes on both sides of the strip or on one side only, without altering cell structure in the least, and with little loss of time.

I claim:

1. In a plant for continuous high current density electrodeposition of metals on other metal bodies in movement, comprising at least one treatment unit having an upper chamber and a lower chamber containing electrolyte and connected by two vertical electroplating cells, wherein the metal body to be plated passes from said upper chamber downwards through the first of said cells to the lower chamber, where it is diverted and returns upwards through the second of said cells to the upper chamber, while the electrolyte is forced to pass in the opposite direction in each of the two cells, the improvement in which only one pumping device is used for each of the treatment units, said pumping device being located at one extremity of only one of the two cells and having its delivery directed into one of said chambers, said one chamber being completely filled with electrolyte which is in continuous communication with the outside of said one chamber only though the other chamber, via said vertical electroplating cells.

2. Plant for the electrodeposition of metals as per claim 1, in which said pumping device is located at the lower extremity of the cell through which the metal body to be plated passes from bottom to top, with the delivery directed into said lower chamber.

3. Plant for the electrodeposition of metals as per claim 2, which said pumping device consists of an ejector whose primary entraining fluid is the electrolyte taken from said lower chamber, while the secondary entrained fluid is electrolyte sucked through said cell from said one upper chamber.

* * * * *